United States Patent [19]

Goins

[11] 4,068,828

[45] Jan. 17, 1978

[54] BLENDING OF PARTICULATE MATERIALS

[75] Inventor: Robert R. Goins, Bartlesville, Okla.

[73] Assignee: Phillips Petroleum Company, Bartlesville, Okla.

[21] Appl. No.: 743,197

[22] Filed: Nov. 19, 1976

[51] Int. Cl.[2] ..... B01F 15/00; B01F 5/00

[52] U.S. Cl. ..... 366/136; 366/338

[58] Field of Search ..... 259/4 R, 95, 18, 36, 259/180; 222/459

[56] References Cited

U.S. PATENT DOCUMENTS

| | | | |
|---|---|---|---|
| 3,268,215 | 8/1966 | Burton | 259/180 |
| 3,275,303 | 9/1966 | Goins | 259/180 X |
| 3,421,739 | 1/1969 | Alberts | 259/4 R |
| 3,539,154 | 11/1970 | Goins | 259/4 R |
| 3,936,037 | 2/1976 | Leonard | 259/180 |

*Primary Examiner*—Edward J. McCarthy

[57] ABSTRACT

Particulate materials are blended in a vessel which has a plurality of vertically extending conduits therein. The conduits are provided with a plurality of openings within the vessel, and terminate in a common collection zone. Certain of the openings are provided with baffle means to permit particles to enter the tubes when there is flow of particles through the tubes from higher elevations. The locations of the openings and the baffle sizes are selected such that the total flow of particles through the conduits at progressively lower elevations in the vessel increases substantially as a linear function with respect to vertical distance measured downwardly. An inverted cone can be employed in the bottom of the vessel to provide more uniform mixing of materials that do not flow through the conduits.

12 Claims, 9 Drawing Figures

BLENDING OF PARTICULATE MATERIALS

It is often necessary to blend particulate materials in order to produce uniform mixtures. In the plastics industry, for example, slight variations in properties of polymers may occur in different production runs. Blending of the pellets made in such runs is important to insure products of uniform quality. When color concentrates are added to polymer pellets in order to produce pigmented resins, it is necessary to blend the concentrates with the pellets in order to produce a uniform color. As disclosed in U.S. Pat. No. 3,216,629, 3,275,303 and 3,456,922, efficient blending of particulate materials can be accomplished by the use of apparatus which comprises a vessel having a plurality of vertically extending conduits therein. The solids to be blended are positioned within the vessel to surround the conduits. The conduits are provided with openings through which the particles enter the conduits to flow by gravity to a common collection zone.

While blending apparatus of the type disclosed in the foregoing patents has been found to be quite effective, it is sometimes necessary to recycle the blended mixture through the vessel in order to obtain a final blend having an extremely high degree of uniformity. In accordance with the present invention, improved blenders of the general type described above are provided. The blenders of this invention utilize openings in the conduits which are provided with baffle means so that particles can enter the openings at a plurality of elevations even though the conduits are conveying particles which have entered the conduits from higher elevations in the vessel. In one embodiment of this invention, the locations of the openings in the conduits and the baffle means are selected such that the total flow of solids at progressively lower elevations in the vessel increases substantially as a linear function with respect to vertical distance measured downwardly in the vessel. This arrangement of openings permits zones at various elevations within the vessel to drain in a manner proportional to the size of the zones, and thereby provides a uniform blend of particles. In another embodiment of this invention, a double cone baffle is employed in the lower region of the vessel to facilitate uniform flow of particles that do not flow through the conduits.

In the accompanying drawing.

Figure 1:
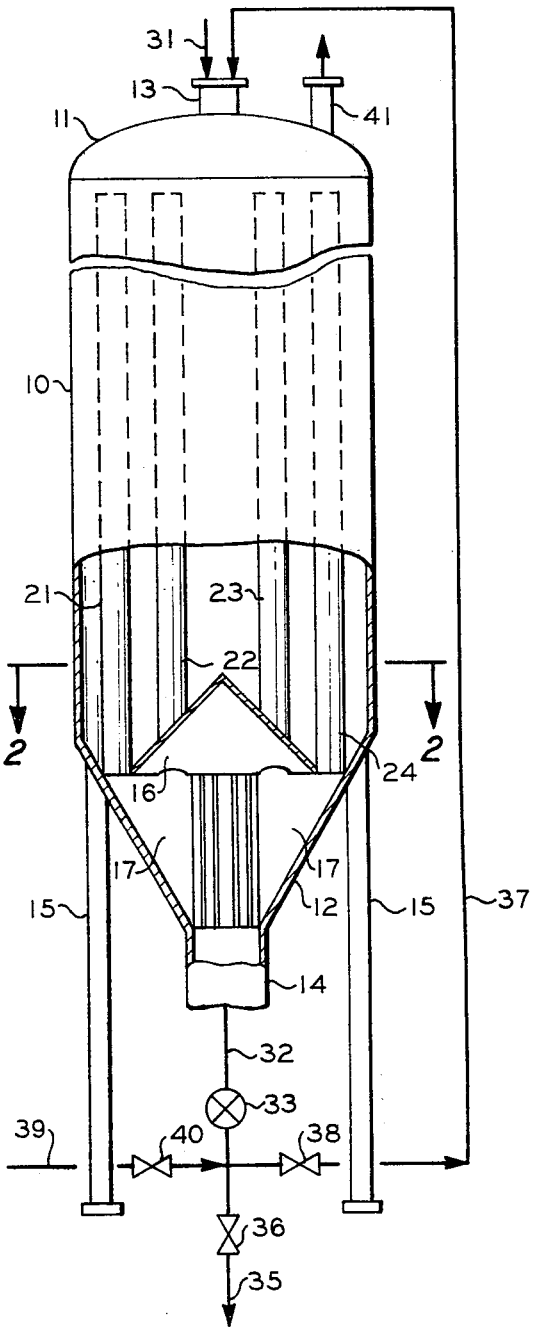
FIG. 1 illustrates a first embodiment of the blending apparatus of this invention.
Figure 2:
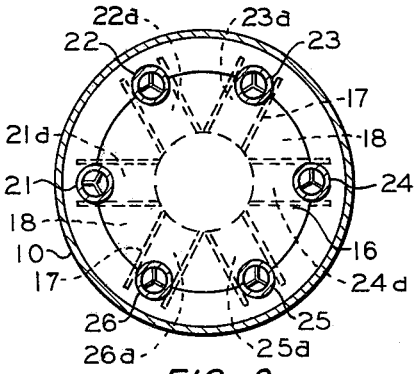
FIG. 2 is a view taken along 2—2 in FIG. 1.

Referring now to the drawing in detail and to FIGS. 1 and 2 in particular, there is shown an upright cylindrical vessel 10 having a top closure 11 and a conically shaped bottom closure 12. Closure 11 is provided with a filling port 13. Closure 12 terminates in a withdrawal pipe 14 which forms an outlet in the vessel. Vessel 10 is supported in a vertical position by legs 15. A conically shaped baffle 16 is disposed in the lower section of vessel 10. A plurality of baffle plates 17 are positioned below baffle 16 to provide passages for the flow of particles, as will be described.

Figure 3:
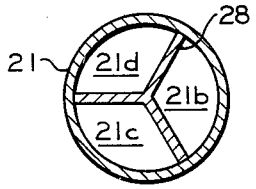
FIG. 3 is a cross-sectional view of one of the conduits disposed within the vessel of FIG. 1.
Figure 4:
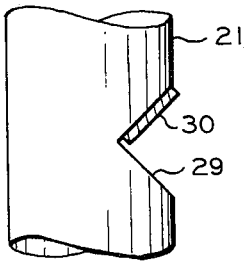
FIG. 4 illustrates an opening in one of the conduits.

A plurality of conduits 21 to 26 are positioned in the upper region of vessel 10 by suitable supports, not shown, so that the conduits extend in generally vertical directions through the vessel. The lower ends of these conduits are positioned with respect to baffle 16 so that material flowing downwardly through conduits 21 to 26 enters respective regions **21*a* to 26*a* between plates 17 and is withdrawn through pipe 14. As illustrated in FIG. 3, each of the conduits is provided with a divider, such as 28 which divides conduit 21 into three separate regions 21*b*, 21*c* and 21*d*. Thus, each conduit is in effect three conduits so that a total of eighteen conduits is provided in the illustrated embodiment. The conduits are provided with a plurality of openings, the locations of which are described in detail hereinafter, to permit solid particles within vessel 10 above baffle 16 to enter the conduits and flow downwardly by gravity. One such opening 29 is illustrated in FIG. 4. This opening can be formed by making two cuts into the conduit at an angle of about 120°, for example. A plate 30 is disposed across the opening so as to form a baffle means to divert the solids flowing downwardly through the conduit (from an upper location) away from a portion of the opening. This baffle means can reduce the flow from an upper location by about 10 to 30%. The baffle means thus permits particles to enter the conduit at the region of opening 29** even though particles are flowing downwardly through the conduit from an upper elevation.

As illustrated in FIG. 1, vessel 10 can be filled with particles to be blended by a conduit 31 which communicates with port 13. A conduit 32, having a control means such as a star valve 33 therein, is connected to pipe 14 to withdraw blended particles. Conduit 32 is connected to a withdrawal conduit 35 which has a valve 36 therein. In some operations it may be desirable to recycle blended particles from conduit 32 back to the upper region of vessel 10. This can be accomplished by a conduit 37, having a valve 38 therein, which extends from conduit 32 to inlet port 13. A conduit 39, which has a valve 40 therein, extends from a source of pneumatic pressure, not shown, to the inlet of conduit 37. The blended particles can thus be elevated and reintroduced into vessel 10. Top closure 11 can be provided with a vent 41 to permit the transport air to be exhausted from the vessel.

In a first method of operation in accordance with this invention, valve 33 is positioned for no flow and vessel 10 is filled with particles to be blended. Valve 33 is then actuated for flow and valve 36 is opened to permit the particles to drain by gravity from the vessel to output conduit 35. Valve 40 is closed at this time so that no particles are recycled. In another embodiment of this invention, the vessel can be operated in the same manner except that blending is accomplished continuously with particles to be blended being introduced through inlet 31 and withdrawn through outlet 32 at the same time. In still another method of operation, a part or all of the blended particles can be recycled through conduit 37 back to inlet 13 for further blending. Even in the single pass batch blending procedure, it is usually desirable to recycle a part of the blend initially withdrawn from pipe 14.

Figure 5:
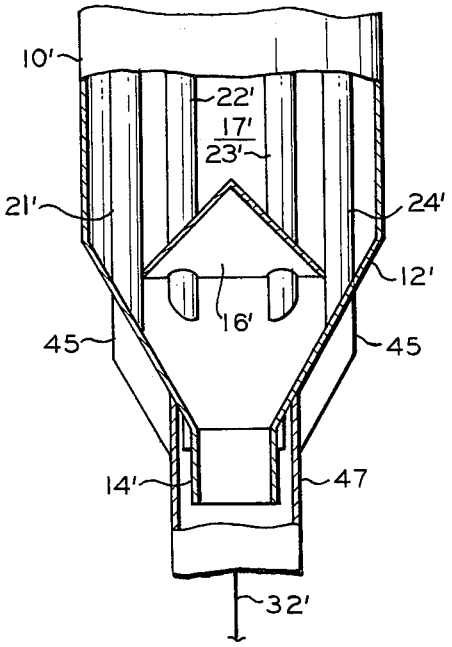
FIGS. 5, 6 and 7 are partial views of additional embodiments of the blending apparatus.

A second embodiment of the apparatus in illustrated in FIG. 5 wherein elements corresponding to those shown in FIG. 1 are designated by like primed reference numerals. In the embodiment illustrated in FIG. 5, the vertical conduits 21' to 26' extend through closure member 12'. However, these vertical conduits terminate in external conduits 45 which in turn communicate with a conduit 47 which encloses outlet 14' at its upper end. In the embodiment of FIG. 5, which is the preferred embodiment of this invention, conduits 47 and 14' are sized so as to control the relative flows through conduits 21' to 26' and around these conduits directly into pipe 14'. Plates 17 in FIG. 1 serve this same function to control the relative flows through and around the vertical conduits. The flows around the conduits of FIG. 2 flow through passages 18 to outlet 14.

Figure 6:
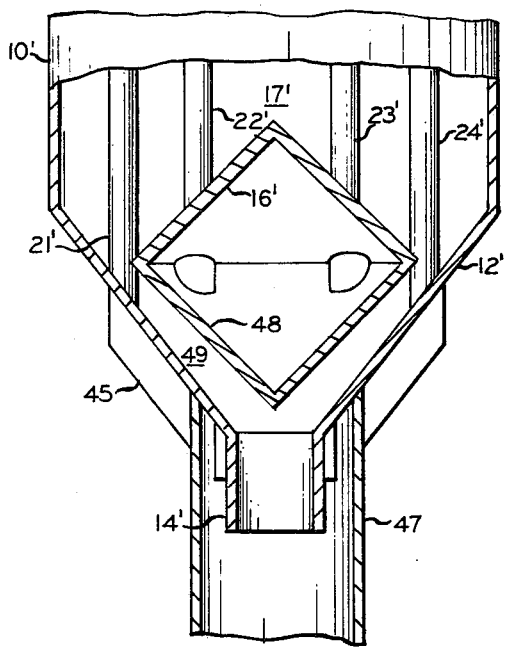

In the embodiment illustrated in FIG. 6, an inverted cone 48 has been added to the embodiment of FIG. 5. Cone 48 is disposed beneath baffle 16' to form an annular passage 49 through which the particles pass which flow around baffle 16' rather than through a conduit. This annular passage confines the particles to a more restricted path and tends to eliminate any tendency for the particles to stagnate in the lower region of the vessel beneath baffle 16'.

Figure 7:
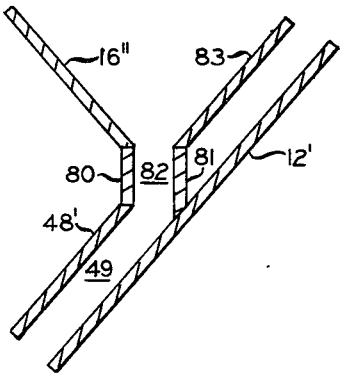

A partial view of a modification of the apparatus of FIG. 6 is illustrated in FIG. 7. The edges of baffle 16'' and cone 48' are separated by a ring 80. A second ring 81 is spaced from ring 80 to form an annular passage 82 which communicates with passage 49. An annular plate 83 is spaced from bottom closure 12' to form a false bottom. The pellets are thus directed into passage 82 by the two inclined surfaces of baffle 16'' and plate 83. This forms a chute to reduce any tendency of the particles to stagnate. If plate 83 is made sufficiently strong, closure 12' above ring 81 can be eliminated.

In accordance with this invention, the openings in the vertical conduits are spaced and the sizes of baffle plates 30 are selected so that the total flow of particles through the conduits at progressively lower levels in the vessel increases substantially as a linear function with respect to vertical distance measured downwardly. For purposes of explaining how to locate the openings, it will be assumed that each of the vertical conduits is of such a size relative to conduits 45 as to be capable of passing 100 pounds of particles per hour. Baffle plates 30 are of such a size as to permit 20% entry of particles through any given opening 29. If each conduit is capable of passing 100 pounds of particles per hour and baffle 30 permits 20% entry of particles, the lowermost opening in a given conduit will introduce 20 pounds of particles per hour, with 80 pounds per hour flowing past the opening from above. The next higher opening (assuming that it is not the uppermost opening of that conduit) will introduce 20% of the 80 pounds per hour, or 16 pounds per hour. This means that 80 minus 16, or 64, pounds per hour flows past such a second opening from the bottom. Similarly, a third opening from the bottom (again assuming that it is not the uppermost opening of that conduit) will introduce 13 pounds per hour (20% of 64). Thus, the uppermost openings of conduits supplied with two, three and four openings introduce 80, 64, and 51 pounds per hour, respectively.

Figure 8:
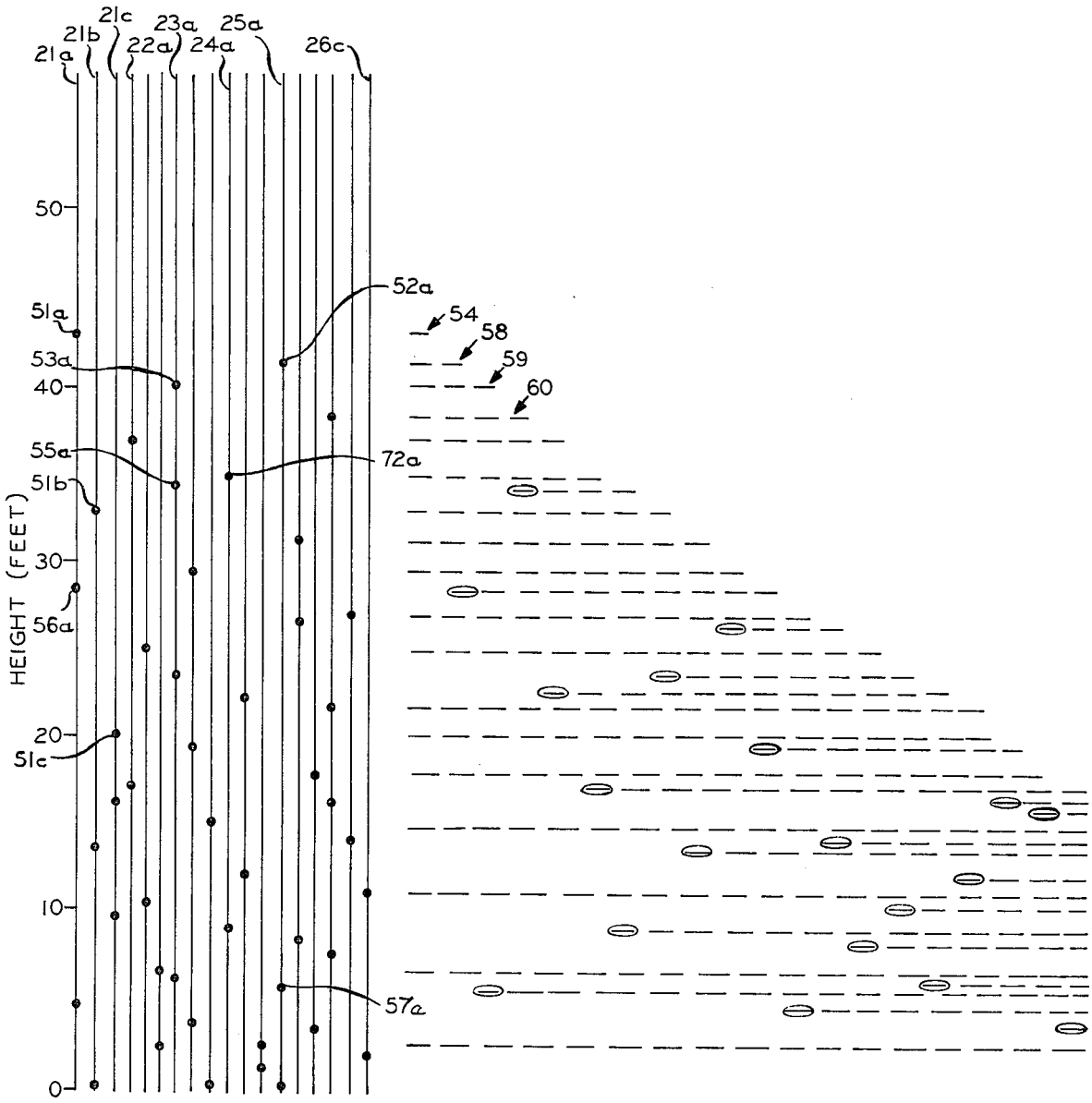
FIGS. 8 and 9 illustrate the locations of openings in the conduits in an embodiment of the blending apparatus of this invention.

In order to locate the positions of the conduit openings, a chart of the type shown in FIG. 8 is constructed. The 18 vertical lines on the left side of FIG. 8 represent the 18 conduit sections of the blending apparatus. The vertical scale represents the height at which openings are to be formed in the conduits. The first step is to locate the top openings of each conduit on the chart. This is accomplished by placing the openings in a generally uniform pattern from top to bottom. Although not essential, it is convenient to locate the top openings in corresponding sections of the conduits so that first section *a* openings are generally in the top third of the vessel, second *b* sections are in the middle third, and the third *c* sections are in the bottom third. The locations of the selected openings is shown as dots on the lines in FIG. 8. For example, dot 51*a* represent the top opening in conduit 21*a*, dot 51*b* represents the top opening in conduit 21*b* and dot 51*c* represents the top opening in conduit 21*c*. A first, vertical column of dash lines 54 is then formed on the right side of FIG. 6 to designate the locations of the top openings. This column of 18 dashes provides a visual indication of the uppermost opening locations. As previously mentioned, these spacings should be generally uniform in the first step of the opening location procedure. They are not so shown in FIG. 8 because the positions shown in the FIGURE represent the final locations, which may be changed somewhat by the following steps of the procedure.

The next step involves locating the second openings from the tops of the conduits. These second openings are represented by dots 55*a*, 56*a* and 57*a* in respective conduit sections 23*a*, 21*a* and 25*a*, for example. A second column of dash lines 58 is then formed by assuming the level of solids in the blender is just below openings 51*a*, thus rendering it inoperative. To take the place of inoperative opening 51*a*, opening 56*a* is made in conduit 21*a* and designated by a circled dash in the second vertical column of dashes 58. In repetitive fashion, the solids level is assumed to descend below the next lowermost opening 52*a* in a conduit 25*a*, thus rendering 52*a* inoperative. Opening 57*a* is then inserted in a lower level of conduit 25*a* and a circled dash inserted in the third vertical columns of dashes 59 to mark the location of said opening 57*a*. The solids level is again lowered to a point just below opening 53*a* and opening 55*a* inserted in conduit 23*a* to take its place. A fourth column of dashes 60 is prepared and includes a circled dash to indicate the location of opening 55*a*. This procedure is repeated to the bottom of the blender, the solids level being lowered by one opening at a time and another opening inserted in the same conduit. The columns of dashes assist in locating the new openings in a uniform manner from top to bottom of the blender.

The new openings are located so as to make the overall pattern of openings as uniform as possible. Thus, if a new opening is located in the upper quadrant of the vessel, then in general the next opening will be located in the lower quadrant. The next opening will be located somewhere in the middle of the blender, etc. While the above-described procedure in generally followed, deviation is sometimes necessary in order to avoid locating a new opening in a conduit adjacent to an old opening in an adjoining conduit in the same drain pipe. The new opening is then located above or below the old opening, whichever location best provides uniformity of openings. The opening locations are selected so that a relatively uniform distribution of openings is finally provided. In order to save space on the drawing, not all of the dash lines are shown in FIG. 8.

Figure 9:
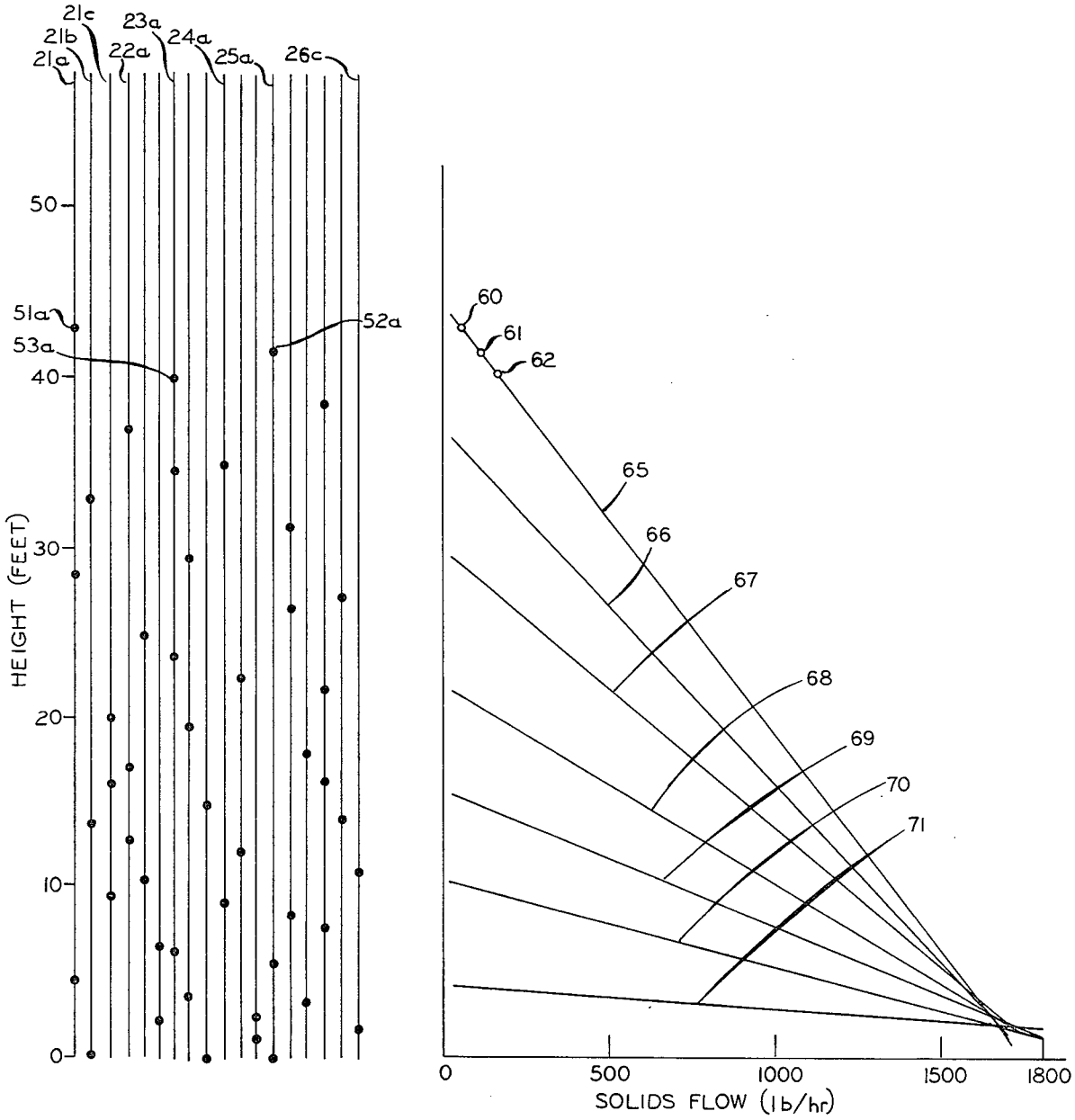

The next step is to plot the actual drainage flow pattern of solids from the blending apparatus at different locations. FIG. 9 is constructed for this purpose. The left side of FIG. 9 corresponds to the left side of FIG. 8 and shows the locations of the openings in the conduits. The right hand of FIG. 9 is a plot of height of the conduits versus solids flow through the conduits in pounds per hour. It is first assumed that the blender has been filled with solids and is to be emptied without the addition of more solids. The uppermost opening in conduit 21*a* at location 51*a* will drain solids at a rate of 64 pounds per hour. This drain rate is discussed above with respect to a conduit having three openings therein. A first point 60 is plotted on FIG. 9 to show a flow of 64 pounds per hour at the elevation of opening 51*a*. At the next lower opening 52*a* in conduit 25*a*, the total drainage is the sum of the 64 pounds per hour through the opening at 51*a* and an additional 64 pounds per hour through the opening at 52*a* in conduit 25*a*. A second point 61 is plotted on FIG. 9 to illustrate this total flow of 128 pounds per hour at the location of the uppermost opening 52*a* in conduit 25*a*. The next highest opening at 53*a* is in conduit 23*a*, which conduit is provided with a total of four openings. The opening at 53*a* contributes a flow of 51 pounds per hour so that the total flow at this location is 179 pounds per hour. This is represented by point 62 in FIG. 9. This procedure is continued for all 47 of the conduit openings illustrated in FIG. 9. A curve 65 is then drawn through these points.

If curve 65 is linear, the openings have been selected properly to provide uniform draining when the blender is full. If curve 65 is not linear, the individual opening locations should be adjusted to provide a substantially linear curve by the foregoing procedure. Once this has been accomplished, a series of additional flow calculations are made at a number of spaced levels in the blender to determine if linear flow occurs as the blender is emptied. A number of additional curves 66 through 71 are formed in the same manner as discussed above. In forming curve 66, for example, all of the openings above an elevation of approximately 36 feet have been desregarded. This means that opening 72*a* in conduit 24*a* is now the uppermost opening for purposes of computation. At this time it is necessary to determine the remaining number of openings in each conduit below this level to determine flows through the conduit sections by the procedure discussed above. If the hole selection is proper, all of the curves 65 to 71 will be substantially linear. Adjustments of hole locations are made as required to provide the best possible series of linear curves. It is recognized that the actual hole spacing is a trial and error procedure to some extent. However, the correct spacing when finally obtained can be verified by constructing the curves of FIG. 9 and determining that they are linear.

It is desirable to construct the blending apparatus so that there is some flow of particles between baffle 16 and bottom closure 12. This tends to eliminate any dead space in the bottom of vessel 10. Such flow should be relatively small, generally about 5 to 15% of the total flow for single pass blending in order that most of the flow be through the conduits to provide uniform mixing. However, if particles are recycled through conduit 37 to any appreciable extent, the flow around the conduits can be greater, 20 to 40%, for example.

In one specific embodiment of this invention, vessel 10′ is of the configuration of FIGS. 3, 4 and 5. The vessel has an internal diameter of about 12¾ feet, with the vertical conduits being located on a circle of 4 ft. radius. The height of vessel 10′ is about 48 feet. The vertical conduits are formed of 5 inch pipe. The locations of the openings in the conduit sections are set forth in the following table, with distances being measured from the lowermost opening. This lowermost opening is adjacent the bottom of a divider 28, which is approximately 0.5 foot from the bottom of the vertical conduit in which it is placed. The location in this table represent the locations illustrated in FIGS. 8 and 9.

| Conduit | Openings (feet from bottom opening) | | | |
|---|---|---|---|---|
| 21a | 43.0 | 28.5 | 4.5 | — |
| 21b | 33.0 | 13.5 | 0 | — |
| 21c | 20.0 | 16.0 | 9.5 | — |
| 22a | 37.0 | 17.0 | 12.75 | — |
| 22b | 25.0 | 10.25 | — | — |
| 22c | 6.5 | 2.0 | — | — |
| 23a | 40.0 | 34.5 | 23.75 | 6.0 |
| 23b | 29.5 | 19.5 | 3.5 | — |
| 23c | 15.0 | 0 | — | — |
| 24a | 35.0 | 9.0 | — | — |
| 24b | 22.5 | 12.0 | — | — |
| 24c | 2.25 | 1.0 | — | — |
| 25a | 41.5 | 5.25 | 0 | — |
| 25b | 31.5 | 26.5 | 8.25 | — |
| 25c | 18.0 | 3.25 | — | — |
| 26a | 38.5 | 21.5 | 16.5 | 7.5 |
| 26b | 27.0 | 14.0 | — | — |
| 26c | 11.0 | 1.5 | — | — |

Each opening is a sawed slot having a maximum vertical opening of 3.75 inches, and each opening, except the top opening in each conduit section, is provided with a baffle plate to permit about 20% flow of particles into the opening, based on total flow through the conduit section.

While this invention has been described in conjunction with presently preferred embodiments, it obviously is not limited thereto.

What is claimed is:

1. Solids blending apparatus comprising:

a vessel having a solids inlet in the upper region thereof and a solids outlet in the lower region thereof;

a first baffle disposed within said vessel between said upper region and said lower region, said first baffle blocking a substantial amount of communication between said first and second regions; and a plurality of conduits positioned within said vessel so as to extend in generally vertical directions downwardly from said upper region past said baffle to said lower region, each of said conduits having at least one first opening therein in said upper region to permit solids disposed in said upper region to enter the conduit and flow by gravity downwardly toward said lower region, each of said conduits having a second opening in said lower region to discharge solids into said lower region, all of said first openings except the uppermost in each of said conduits being provided with baffle means to permit solids to enter the conduit when solids are flowing downwardly through the conduit from a region above the opening, and the vertical locations and numbers of said first opening and the sizes of said baffle means being such that when the upper region of said vessel is filled with solids to the uppermost first opening and permitted to empty by gravity flow of solids through said conduits the total flow of solids through said conduits at progressively lower elevations increases substantially as a linear function with respect to vertical distance measured downwardly from said uppermost first opening.

2. The apparatus of claim 1 wherein said baffle means are of such configuration as to permit entry of solids into each conduit of about 10 to 30% of the total flow of solids through the conduit at the point of entry.

3. The apparatus of claim 1 wherein said baffle means are of such configuration as to permit entry of solids into each conduit of about 20% of the total flow of solids through the conduit at the point of entry.

4. The apparatus of claim 1 wherein said conduits are formed by a plurality of second conduits, each of which is provided with at least one longitudinally extending divider to divide the second conduit into at least two of the first-mentioned conduits.

5. The apparatus of claim 1 wherein said conduits and said vessel are of such configuration as to permit about 5 to 15% of the total flow of solids from said upper region to said outlet to pass between said baffle and said vessel rather than through said conduits.

6. The apparatus of claim 1, further comprising conduit means extending from said outlet to an upper portion of said upper region to pass solids to said upper portion.

7. The apparatus of claim 1 wherein the bottom of said vessel slopes inwardly, and wherein said first baffle comprises a first conically shaped member with the apex thereof pointed upwardly and a second conically shaped member with the apex thereof pointed downwardly, said second member being positioned beneath said first member and spaced from the bottom of said vessel to form an annular passage.

8. The method of blending solids which comprises introducing solids to be blended into the vessel of claim 1 through said solids inlet, and withdrawing blended solids through said solids outlet.

9. The method of claim 8 wherein solids are not withdrawn from said outlet until all of the solids to be blended at a given time are disposed in said vessel.

10. The method of claim 8 wherein solids are withdrawn from said outlet during the time that solids are introduced through said inlet.

11. The method of claim 8 wherein a portion of the solids withdrawn from said outlet are returned to an upper portion of said upper region.

12. The apparatus of claim 1 wherein the location of said first openings was determined by the steps of:

a. locating said openings in a uniform manner from top to bottom of said conduits.

b. determining the actual drainage flow pattern of solids from said blending apparatus when said apparatus is filled with solids, c. adjusting the location of individual first openings to provide substantially linear flow of solids from said blending apparatus, and d. repeating steps (b) and (c) based upon at least one lower level of solids in said blending apparatus.

* * * * *